US011549684B2

(12) United States Patent
Kejik

(10) Patent No.: US 11,549,684 B2
(45) Date of Patent: Jan. 10, 2023

(54) BURNER SYSTEM CONTROL

(71) Applicant: Honeywell International Inc., Morris Plains, NJ (US)

(72) Inventor: Pavel Kejik, Blansko (CZ)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 189 days.

(21) Appl. No.: 16/113,923

(22) Filed: Aug. 27, 2018

(65) Prior Publication Data

US 2020/0063960 A1 Feb. 27, 2020

(51) Int. Cl.
*F23N 5/24* (2006.01)
*F23N 5/26* (2006.01)

(52) U.S. Cl.
CPC ..... *F23N 5/242* (2013.01); *F23N 5/265* (2013.01); *F23N 2223/04* (2020.01); *F23N 2223/08* (2020.01); *F23N 2229/00* (2020.01)

(58) Field of Classification Search
CPC ..... F23N 2223/04; F23N 2223/08; F23N 2229/00; F23N 5/242; F23N 5/265
See application file for complete search history.

(56) References Cited

U.S. PATENT DOCUMENTS 4,188,180 A 2/1980 Hamelink
4,375,951 A 3/1983 Bohan, Jr.
4,429,705 A 2/1984 Ritchart
4,923,117 A * 5/1990 Adams ..... F23N 1/002 236/94
5,020,988 A 6/1991 Peterson
5,718,256 A 2/1998 Buezis et al.
5,899,925 A * 5/1999 Ochs ..... A61N 1/3931 607/5
6,301,527 B1 10/2001 Butland et al.
6,330,516 B1 12/2001 Kammeter
6,952,727 B1 10/2005 Lindner et al.
7,174,482 B2 * 2/2007 Voleti ..... H04L 43/00 714/39
9,423,172 B2 8/2016 Wong et al.
9,806,530 B2 10/2017 Martinez (Continued)

OTHER PUBLICATIONS

Modbus; "MODBUS application protocol specification"; Dec. 28, 2006; modbus.org/docs/Modbus_Application_Protocol_V1_1b.pdf (Year: 2006).*

(Continued)

*Primary Examiner* — Jorge A Pereiro
*Assistant Examiner* — Logan P Jones
(74) *Attorney, Agent, or Firm* — Seager, Tufte & Wickhem, LLP

(57) ABSTRACT

A controller for managing communication of a burner system. The controller may comprise a communication module to manage the exchange of messages between devices of the burner system. The controller may also incorporate a processing module to compose the messages that are exchanged between the devices, identify issues regarding the messages, determine that devices may not be operating properly, and lock-out the devices in response. The controller may also incorporate a timing module having a set of timing requirements and being configured to lock-out devices in response to violation of a timing requirement.

17 Claims, 8 Drawing Sheets

(56) References Cited

U.S. PATENT DOCUMENTS

| | | | | |
|---|---|---|---|---|
| 2003/0154056 | A1* | 8/2003 | Ito | G01D 21/02 702/188 |
| 2005/0267710 | A1* | 12/2005 | Heavner, III | F23N 5/003 702/183 |
| 2006/0177785 | A1* | 8/2006 | Varagani | F23N 5/006 431/12 |
| 2006/0218343 | A1* | 9/2006 | Higashijima | G06F 11/1076 711/114 |
| 2007/0175624 | A1* | 8/2007 | Affolter | F23N 5/242 165/287 |
| 2011/0016362 | A1* | 1/2011 | Holzaepfel | H04L 43/0852 714/51 |
| 2012/0166000 | A1* | 6/2012 | Ellena | G05B 19/042 700/287 |
| 2012/0311413 | A1* | 12/2012 | Pelletier | H04L 9/3271 714/807 |
| 2014/0039805 | A1* | 2/2014 | Sharpe, Jr. | F04B 49/065 702/24 |
| 2015/0316262 | A1* | 11/2015 | Immer | F23N 5/00 431/2 |
| 2016/0091903 | A1* | 3/2016 | Patton | G06F 13/4282 700/276 |

OTHER PUBLICATIONS

Zhou, Yue; 13 Real-time Communication using Foundation Fieldbus; Shenyang Institute of Automation, Chinese Academy of Sciences; 2003 (Year: 2003).*

* cited by examiner

BURNER SYSTEM CONTROL

BACKGROUND

The disclosure relates generally to burner systems, and more particularly to managing communication between devices of a burner system to provide safety control over the burner system. Fuel burner systems typically operate under varying conditions such as variable fuel and air supply pressures and temperatures, back pressure from the burner, humidity, fuel quality, and so forth. Moreover, fuel burner systems rely on the coordination of several functioning devices/components for safe operation of the overall burner system. Modbus is a widespread royalty-free and open protocol used for serial communication among electronic devices of fuel burner systems. The protocol specification is managed by the Modbus Organization. The specification defines structure of telegrams for data transfer between devices. However, this specification, as it is defined, does not meet the standards for safety-relevant data transfer. As such, there is a current interest for safety-relevant communication that needs to address immunity against threats caused by the malfunctioning of the devices of fuel burner systems.

SUMMARY

This disclosure relates generally to burner systems, and more particularly to managing communication between devices of a burner system to provide safety control over the burner system. In one example, a controller for managing communication of a burner system may incorporate a communication module configured to manage an exchange of messages between devices of the burner system. The controller may also incorporate a processing module configured to compose the messages that are exchanged between the devices of the burner system, identify issues regarding the messages exchanged between the devices of the burner system, determine that a set of devices of the burner system may not be operating properly based on the identified issues regarding the messages, and lock-out at least one device of the burner system in response to determining that the set of devices of the burner system may not be operating properly. The controller may also incorporate a timing module having a set of timing requirements and be configured to lock-out at least one device of the burner system in response to violation of a timing requirement from the set of timing requirements.

Alternatively or additionally to the foregoing, the messages incorporate periodic messages and aperiodic messages.

Alternatively or additionally to any of the embodiments above, the set of timing requirements may include a timing requirement that an amount of the periodic messages received during an amount of time must be below a threshold.

Alternatively or additionally to any of the embodiments above, the set of timing requirements may include a timing requirement that the periodic messages must be received within an amount of time.

Alternatively or additionally to any of the embodiments above, the set of timing requirements may include a timing requirement that response messages to the periodic messages should be received within an amount of time.

Alternatively or additionally to any of the embodiments above, the processing module may determine that the set of devices of the burner system may not be operating properly when the processing module identifies that a message is an exception message.

Alternatively or additionally to any of the embodiments above, the processing module may determine that the set of devices of the burner system may not be operating properly when the processing module identifies a parameter in a message that is outside a range.

Alternatively or additionally to any of the embodiments above, the processing module may determine that the set of devices of the burner system may not be operating properly when the processing module identifies a communication transaction identification that is incorrect.

Alternatively or additionally to any of the embodiments above, the messages may incorporate an address of a device, function code, communication transaction identification, control bits, and an error check.

Alternatively or additionally to any of the embodiments above, the devices of the burner systems may incorporate a valve and a burner control unit.

In another example of the disclosure, a burner management system (BMS) may incorporate a device, a burner control unit operatively coupled to the device and configured to communicate with the device, and a controller operatively coupled to the device and the burner control unit. The controller may be configured to manage an exchange of messages between the device and the burner control unit, identify issues regarding the messages based on the management of the exchange of messages, determine that at least one of the device and the burner control unit may not be operating properly based on the identified issues regarding the messages, and lock-out at least one of the device or the burner control unit in response to determining that the at least one of the device and the burner control unit may not be operating properly.

Alternatively or additionally to any of the embodiments above, the controller may include a set of timing requirements and the controller may be further configured to lock-out at least one of the device or the burner control unit when a message from the managed messages violates at least one timing requirement from the set of timing requirements.

Alternatively or additionally to any of the embodiments above, the managed messages may incorporate periodic messages, and aperiodic messages.

Alternatively or additionally to any of the embodiments above, the set of timing requirements may include a timing requirement that an amount of the periodic messages received during an amount of time should be below a threshold.

Alternatively or additionally to any of the embodiments above, the set of timing requirements includes a timing requirement that the periodic messages needs to be received within an amount of time.

Alternatively or additionally to any of the embodiments above, the set of timing requirements may include a timing requirement that response messages to the periodic messages should be received within an amount of time.

Alternatively or additionally to any of the embodiments above, the controller may determine that the at least one of the device and the burner control unit may not be operating properly when the controller identifies that a message is an exception message.

Alternatively or additionally to any of the embodiments above, the controller may determine that the at least one of the device and the burner control unit may not be operating properly when the controller identifies a parameter in a message is outside a range.

Alternatively or additionally to any of the embodiments above, the controller may determine that the at least one of the device and the burner control unit may not be operating properly when the controller identifies that a communication transaction identification is incorrect.

In another example of the disclosure, an approach for providing a safety control over a burner system using a controller may incorporate managing an exchange of messages between a device of the burner system and a burner control unit of the burner system, identifying issues regarding the messages based on the management of the exchange of messages, determining that at least one of the device and the burner control unit may not be operating properly based on the identified issues regarding the messages, and locking-out at least one of the device or the burner control unit in response to determining that the at least one of the device and the burner control unit may not be operating properly.

The above summary of some illustrative embodiments is not intended to describe each disclosed embodiment or every implementation of the present disclosure. The Figures and Description which follow more particularly exemplify these and other illustrative embodiments.

BRIEF DESCRIPTION OF THE FIGURES

The disclosure may be more completely understood in consideration of the following description in connection with the accompanying drawings, in which.

Figure 1:
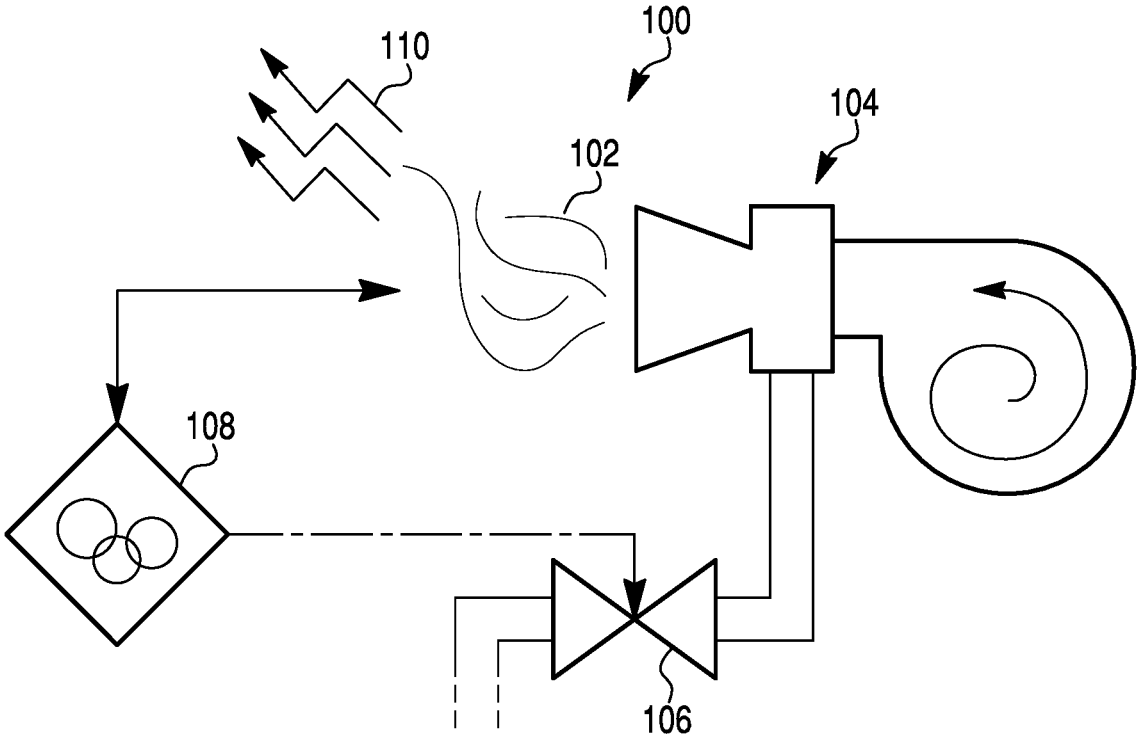
FIG. 1 is a schematic view of an illustrative burner management system (BMS)

While the disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result).

In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", and so on, indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The following description should be read with reference to the drawings in which similar structures in different drawings are numbered the same. The drawings, which are not necessarily to scale, depict illustrative embodiments and are not intended to limit the scope of the disclosure.

Fuel burner systems such as those found in water heaters, furnaces, boilers, and the like, may rely on the coordination of several functioning devices/components for safe operation of the overall burner system. The danger resulting from one or more devices not operating properly is well known. Certain embodiments of the present disclosure may be found in a system, a method, and/or a non-transitory computer-readable storage medium with an executable program stored thereon for managing communication of a burner system. In various embodiments, controller(s) may be configured to manage the exchange of messages between devices of the burner system. In some cases, the controller(s) may also identify issues regarding the messages, determine from the identified issues that certain devices of the burner system may not be operating properly, and lock-out and/or shut down the devices that are not operating properly. Moreover, in some instances, the messages exchanged between the devices may have to satisfy certain timing requirements and the controller(s) may lock-out and/or shut down certain devices that violate these timing requirements. In some cases, because issues are identified regarding the exchange of the messages and/or the messages themselves, the devices may be identified as not operating properly early on and further complications, breakdowns, malfunctions, failures, and so on, relating to the burner system may be avoided. In this regard, the current disclosure may provide safety control over the burner system.

FIG. 1 is a schematic view of an illustrative burner management system (BMS) 100. As shown, the BMS 100 may include a burner 104, a gas valve 106, and a programmable controller 108. In some cases, the burner 104 can be a fuel-air or fuel-oxygen burner to produce (e.g., generate) a flame 102. For example, the burner 104 can be used to produce flame 102, which is used to generate heat 110 for use in residential and/or commercial furnaces, hot water boilers, water heaters, and/or any other suitable application.

In some cases, the programmable controller 108 may be operatively coupled to the burner 104 and the gas valve 106. In operation, the programmable controller 108 may manage the exchange of messages between the valve 106 and the burner 104 (e.g., a burner control unit configured to control the burner 104). The programmable controller 108 may then identify issues regarding the messages between the valve 106 and the burner 104 and/or identify issues regarding the exchange of the messages (e.g., the messages exchanged between the valve 106 and the burner 104 may not satisfy the timing requirements programmed on the programmable controller 108). The programmable controller 108 may then determine that either the valve 106, the burner 104, or both may not be operating properly based on the identified issues regarding the messages. In response, the programmable controller 108 may be configured to lock-out the valve 106, the burner 104, or both such that further complications, malfunctions, or failures relating to the burner 104 may be avoided. For instance, in some cases, the valve 106 can be opened to supply gas to the burner 104 during a call for heat. However, in this case, a message response by the valve 106 to the burner 104 may have violated a timing requirement, such as the valve 106 did not send the response to the burner 104 within a fixed set time (e.g., within 0.5 seconds, 1 second, 2 seconds, 3 seconds, 4 seconds, 5 seconds, and so on), for example. In some examples, the programmable controller 108 may identify that the valve 106 has violated the timing requirement and in response, lock-out the valve 106. In some instances, the valve 106 violating the timing requirement may be because the valve is not operating properly. However, in some cases, the valve may be operating properly and the violation of the timing requirement may be due to some other issue relating to the burner system or the BMS 100. Regardless, because the valve 106 has been locked-out, during a call for heat by the burner 104, the valve 106 will not open to supply gas to the burner 104. Accordingly, in some cases, a user (e.g., a technician, service provider, building owner, and the like) may be alerted by the BMS 100 that the valve 106 has been locked-out and that service and/or evaluation of the valve 106 is needed before the valve 106 is brought back on-line (i.e., operational).

Figure 2A:
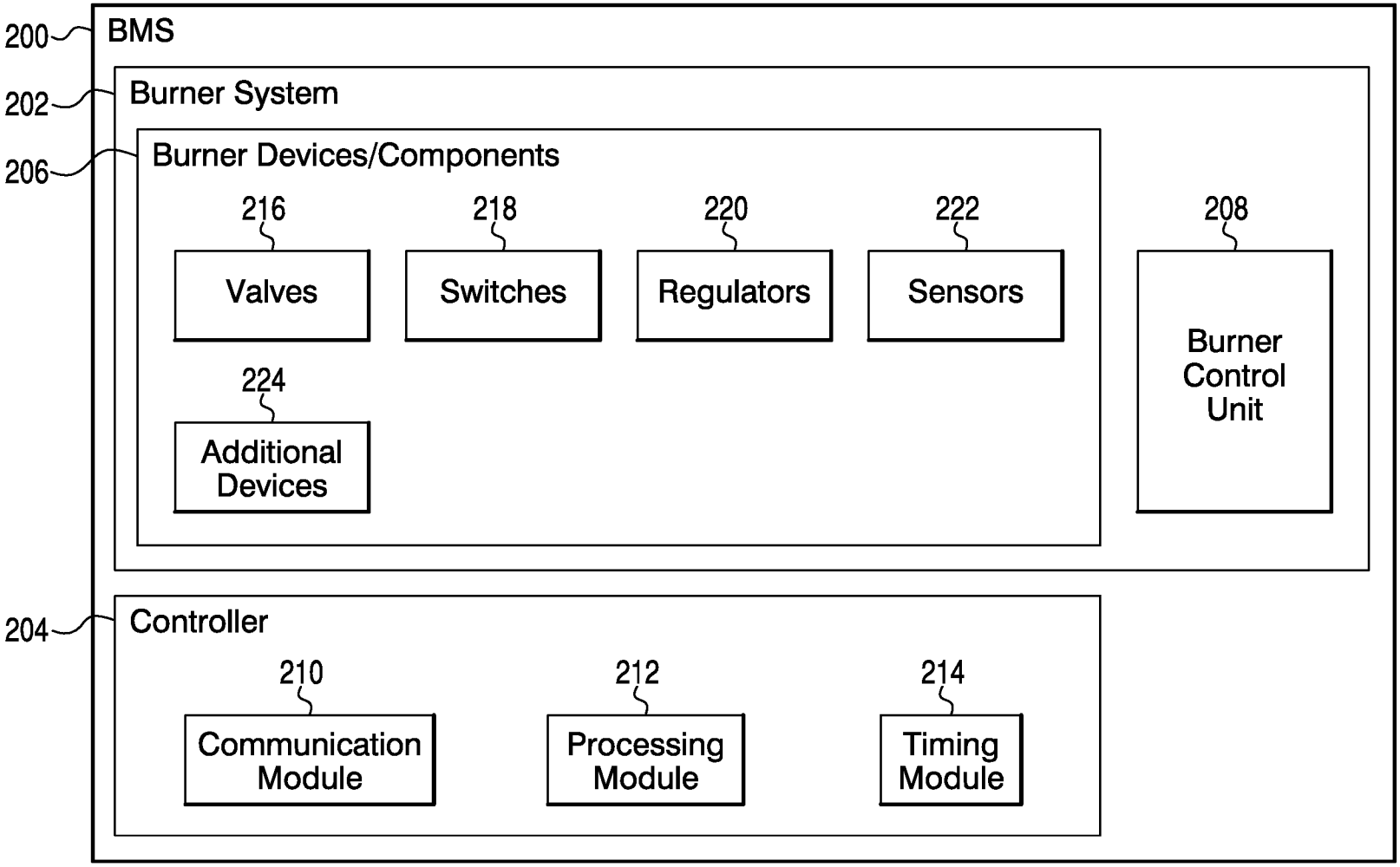
FIG. 2A is a schematic block diagram of an illustrative BMS.

FIG. 2A is a schematic block diagram of an illustrative BMS 200. In some cases, the BMS 200 may be configured similar to the BMS 100, from FIG. 1. In certain embodiments, the BMS 200 may include a burner system 202 and a controller 204. The burner system 202 may include burner devices/components 206 and a burner control unit 208. As shown, the burner devices 206 may include, but are not limited to, valves 216, switches, 218, regulators 220, sensors 222, and additional devices 224. In other embodiments, the burner devices 206 may include more or less devices. In some cases, one or more of the valves 216 may be a Vulcan valve, but this is not necessary. Although shown separately, in some cases, the burner system 202 may include the controller 204. For example, in some instances, the controller 204 may be a part of the burner control unit 208. In some cases, the controller 204 may be part of one or more of burner devices 206, such as valves 216, for example. In some cases, the burner control unit 208 and each of the burner devices 206 may include the controller 204.

In some instances, the burner control unit 208 may include a pre-programmed chip, such as a very-large-scale integration (VLSI) chip and/or an application specific integrated circuit (ASIC). In such embodiments, the chip may be pre-programmed with control logic in order to control the operation of the burner system 202. In some cases, the pre-programmed chip may implement a state machine that performs the desired functions. By using a pre-programmed chip, the burner control unit 208 may use less power than other programmable circuits (e.g., general purpose programmable microprocessors) while still being able to maintain basic functionality. In other instances, the burner control unit 208 may include a programmable microprocessor. Such a programmable microprocessor may allow a user to modify the control logic of the burner control unit 208 even after it is installed in the field (e.g., firmware update), which may allow for greater flexibility of the burner control unit 208 in the field over using a pre-programmed ASIC. In some cases, the burner control unit 208 may be programmed to control the burner devices 206. For instance, the burner control unit 208 can open and close the valves 206, turn the switches 218 on and off, and actuate the regulators 220 and the sensors 222. Moreover, in some cases, the burner control unit 208 can control various aspects of the burner system 202, including initial ignition of the burner system 202 in response to a call for heat, and the termination of the burner system at the end of the call for heat. In some cases, the burner control unit 208 may change the firing rate of the burner system to produce a more intense flame or a less intense flame.

In some cases, the burner control unit 208 may be configured to communicate with the burner devices 206 using one or more communication protocol. For example, in some instances, the burner control unit 208 may include a Modbus protocol application and communicate with the burner devices 206 using a Modbus protocol messaging structure, which is discussed further below. In some cases, the burner control unit 208 may communicate with the burner devices through serial and/or parallel communication using protocols over a BACnet. Other protocols that the burner control unit 208 may use to facilitate communication with the burner device 206 may include, but are not limited to, 1-Wire, C-Bus, CC-Link Industrial Networks, DSI, Dynet, KNX, LonTalk, oBIX, VSCP, xAP, X10, Z-Wave, ZigBee, INSTEON, TCIP, and/or Ethernet.

In some cases, the controller 204 may be configured to manage safety-relevant communication between the burner control unit 208 and the burner devices 206. In some instances, the controller 204 may be a pre-programmed chip or a programmable microprocessor, similar to the burner control unit 208. In some cases, the controller 204 may be an addition to the Modbus protocol application or another protocol application, discussed above, and may ensure an exchange of internal safety data between the burner control unit 208 and the burner devices 206. In some examples, the exchange of internal safety data may include periodic message exchanges and aperiodic message exchanges between the burner control unit 208 and the burner devices 206.

In some cases, periodic message exchanges may include a transfer of data that change often in time between the burner control unit and the burner devices. In some cases, the burner devices may need parameters in order to operate properly. In some instances, the burner devices may need the parameters due to specific events, such as after a burner device has experienced a power-up/online sequence or a change in a setting of the burner system 202 that may require a modification to the behavior of a burner device, for example. In some cases, the aperiodic message exchanges may include a transfer of these needed parameters.

Figures 2B, 2C:
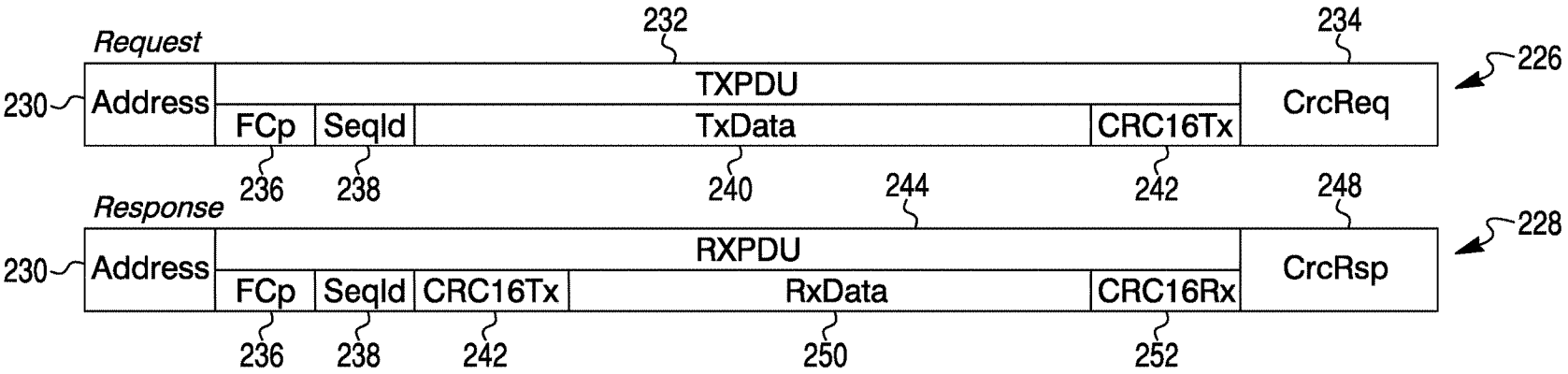
FIG. 2B depicts examples of Modbus protocol message structures for a request message and a response message.
FIG. 2C depicts an example of an exchange of periodic messages.

FIG. 2B depicts examples of Modbus protocol message structures for a request message 226 from the burner control unit 208 and a response message 228 from the burner devices 206. In some cases, the request messages 226 and the response messages 228 may have a similar structure regardless of whether it is a periodic message or an aperiodic message. However, in other cases, the structure of the periodic messages and the aperiodic messages may be different. The Modbus request message 226 from the burner control unit 208 to the burner devices may contain an address 230 of the device (e.g., a valve from valves 216, from FIG. 2A), request data 232 (e.g., TXPDU), and a Modbus frame 234 (e.g., CrcReq) calculated from the address 230 and the request data 232. In some cases, the request data 232 may include function code 236 (e.g., FCp), communication transaction identification 238 (e.g., SeqId), control bits 240 (e.g., TxData), and an error check 242 (e.g., CRC16Tx). In some examples, the function code 236 may tell the addressed device what kind of action to perform, the communication transaction ID 238 may be incremented before each new message transfer, and the control bits 240 may contain any additional information that the addressed device may need to perform the function. For example, function code 236 requests the addressed device to read holding registers and respond with their statuses. The control bits 240 may contain the information telling the addressed device which register to start at and how many registers to read. The error check 242 may provide a method for the addressed device to validate the integrity of the message contents.

In some cases, the Modbus response message 228 from the addressed device to the burner control unit 208 may contain the address 230 of the device, response data 244 (e.g., RXPDU), and a Modbus frame 248 (e.g., CrcRsp) calculated from the address 230 and the response data 244. In some cases, the response data 232 may include the function code 236, communication transaction ID 238, the error check 242, status bits 250 (e.g., RxData), and a control error check 252 (e.g., CRC16Rx). In some examples, if the addressed device makes a normal response, the function code 236 in the response is an echo of the function code 236 in the request. The status bits 250 may contain the data collected by the addressed device, such as the register statuses and the control error check 252 may allow the burner control unit to confirm that the message contents are valid.

In some cases, when an error occurs, the addressed device may send an exception response to the burner control unit 208. In some examples, the exception response may be sent when the addressed device receives a request message, but cannot handle it. Accordingly, the exception response may contain the address 230 of the device, the function code 236 that is modified to indicate that the response is an error response, and error bits that contain a code that describes the error (e.g., a wrong data size, wrong data value, wrong TxData value, and so forth), and a Modbus frame (e.g., CrcExRsp).

Turning to FIG. 2C, an example is shown of a correct exchange of periodic messages between the burner control unit 208 and a device from the burner devices 206 (e.g., the valve 216). In the example shown in FIG. 2C, a processing module 212 (from FIG. 2A) of the controller 204 may compose the request data 232 (i.e., TXPDU) according to the structure described for the request message 226, discussed in regard to FIG. 2B. Once the request data 232 has been composed, a communication module 210 (from FIG. 2A) of the controller 204 may obtain the address for the device such that, the burner control unit 208 may send a periodic request message 254 to the device. The processing module 212 may then compose the response data 232 according to the structure described in regard to the response message 228 (from FIG. 2B). In some cases, a timing module 214 (from FIG. 2A) of the controller 204 may have a set of timing requirements. For instance, as shown, the timing module 214 may have a timing requirement that a response message 256 must be received within a fixed set of time (Tc) (e.g., within 0.5 seconds, 1 second, 2 seconds, 3 seconds, 4 seconds, 5 seconds, and so on). As can be seen in this example, the communication module 210 may coordinate the exchange of the response message 256 from the device to the burner control unit 208 such that, the burner control unit receives the response message 256 within Tc. As such, the timing requirement has been satisfied. Accordingly, the processing module 212 may then identify issues regarding the response message 256. For instance, the processing module 212 may identify that the received response message 256 is an exception response, determine that the device may not be operating properly, and lock-out the device and/or the burner control unit 208. In another example, the processing module 212 may identify that the communication transaction ID 238 is incorrect, determine that the device may not be operating properly, and lock-out the device and/or the burner control unit 208. In another example, the processing module 212 may identify that the error check 242 (e.g., CRC16Tx) is not the same in the response message 256 as it was in the request message 254. As such, the processing module may determine that the device may not be operating properly and lock-out the device and/or the burner control unit 208. These are just a few examples of possible issues that may indicate that the burner devices 206 and/or the burner control unit 208 may not be operating properly and are not to be construed as limiting the current disclosure.

In some cases, the timing module 214 may have a timing requirement that an amount of periodic request messages received during an amount of time (Tmin) must be below a threshold. In some examples, the threshold of request messages that may be received within Tmin may be 3, 4, 5, 6, 7, 8, 9, 10, and so on, messages. Moreover, the timing module 214 may also have a timing requirement that subsequent periodic request messages must be received within an amount of time (Tmax). For example, a subsequent periodic request message must be received within 0.1 seconds, 0.2 seconds, 0.5 seconds, 1 second, 2 seconds, 5 second, and so on. As shown in FIG. 2C, only one periodic request message 254 is received during Tmin and the subsequent periodic request message 258 was received within Tmax. Moreover, the subsequent periodic response message 260 was sent back to the burner control unit 208 from the device within Tc. As such, all the timing requirements have been satisfied.

Figure 2D:
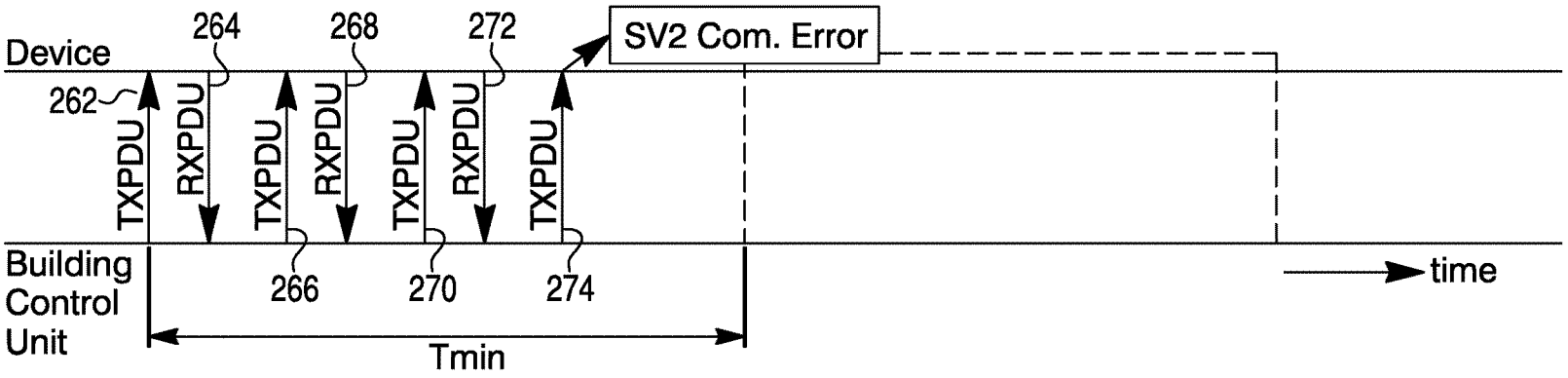
FIG. 2D depicts an example of the number of periodic request messages being above a threshold.

FIG. 2D depicts an example of the number of periodic request messages 226 received during Tmin being above a threshold. In this example, the addressed device may only receive between one and three request messages from the burner control unit 208 during Tmin. As shown, the addressed device receives the first three request messages 262, 266, 270 and sends the response messages 264, 268, 272 within Tc. As such, none of the timing requirements are violated. Moreover, the processing module 212 has not identified any issues regarding the request or response messages. Accordingly, neither the addressed device nor the burner control unit 208 has been locked-out. However, as depicted, the burner control unit 208 sends a fourth request message 274 that is received by the addressed device within Tmin. As such, the timing module 214 may identify that the timing requirement has been violated and lock-out the device and/or the burner control unit 208.

Figure 2E:
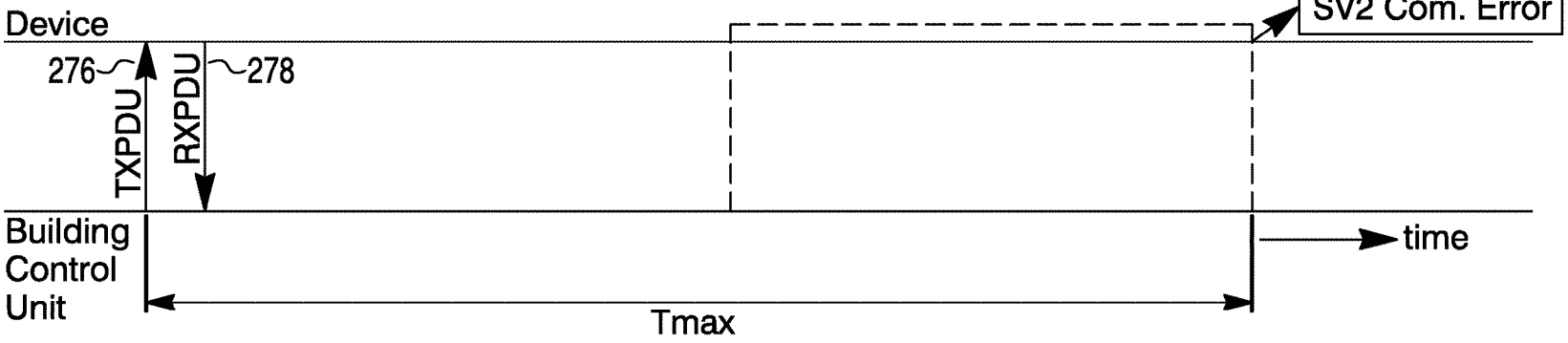
FIG. 2E depicts an example of a subsequent periodic request message not being received within an amount of time.

FIG. 2E depicts an example of the subsequent periodic request message 226 not being received within Tmax. As shown, the addressed device receives the first request message 276 and sends the response message 278 within Tc. As such, none of the timing requirements has been violated. Moreover, the processing module 212 has not identified any issues regarding the request or response messages. Accordingly, neither the addressed device nor the burner control unit 208 has been locked-out. However, as depicted, the burner control unit 208 does not send a second periodic request message within Tmax. As such, the timing module 214 may identify that the timing requirement has been violated and lock-out the device and/or the burner control unit 208.

Figure 2F:
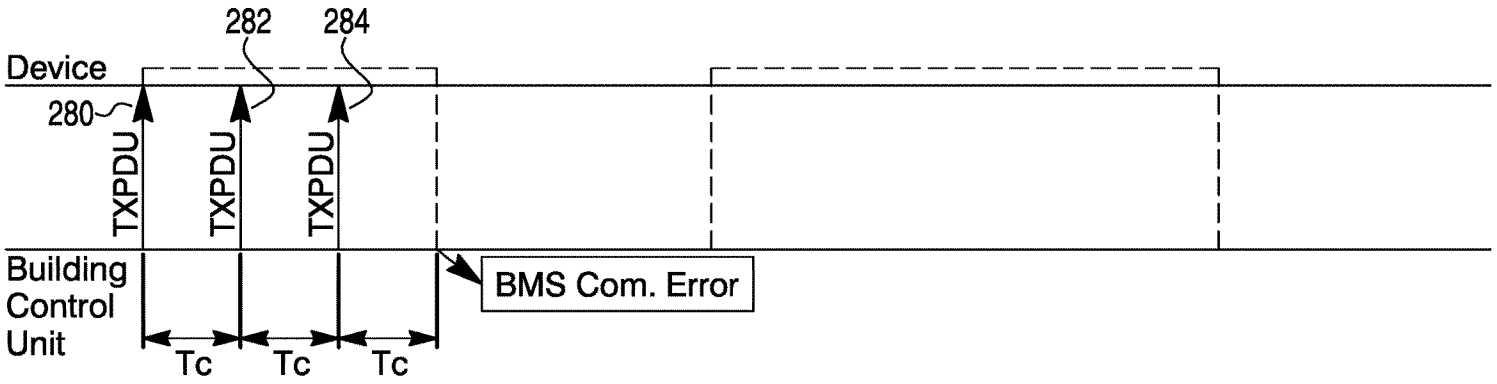
FIG. 2F depicts an example of a periodic response message not being received within an amount of time.

FIG. 2F depicts an example of the periodic response message 228 not being received within Tc. In this example, the burner control unit 208 may send up to three request messages 208 if a response message 228 is not received within Tc. As shown, the burner control unit 208 sends a first request message 280. After waiting Tc without receiving the response message, the burner control unit 208 sends a second request message 282. After waiting Tc without receiving the response message, the burner control unit 208 sends a third request message 284. After waiting Tc, the timing module 214 may identify that the timing requirement has been violated and lock-out the device and/or the burner control unit 208.

According to various examples, apart from data exchange, the periodic messaging communication may be used as a safety means to shut down the burner system 202 if something goes wrong on either the burner devices 206 side or the burner control unit 208 side. The periodic messaging communication may be used as a safety check that needs to be satisfied regularly. If it is not satisfied, it may prevent the burner system 202 from operating. For instance, in cases when an internal fault of a device is present, it may stop responding to the request messages of the burner control system 208. As such, the controller 204 may lock-out the burner control unit 208 in order to shut down the device. This also applies to the scenario when a device from the burner devices 206 is completely uncontrollable (i.e., the firmware is out of control). Additionally, if an internal fault of the burner control unit 208 is present, it may stop sending periodic request messages to the device. As such, the controller 204 may lock-out the device causing the device to shut down.

As discussed above, in some cases, the burner devices 206 may need parameters in order to operate properly. For example, the burner devices 206 may need the parameters due to a specific event, such as after a burner device has experienced a power-up/online sequence or there has been a change in a setting of the burner system 202 that may require a modification to the behavior of the burner devices 206. In some cases, aperiodic messages may be used to transfer these needed parameters.

Figure 3A:
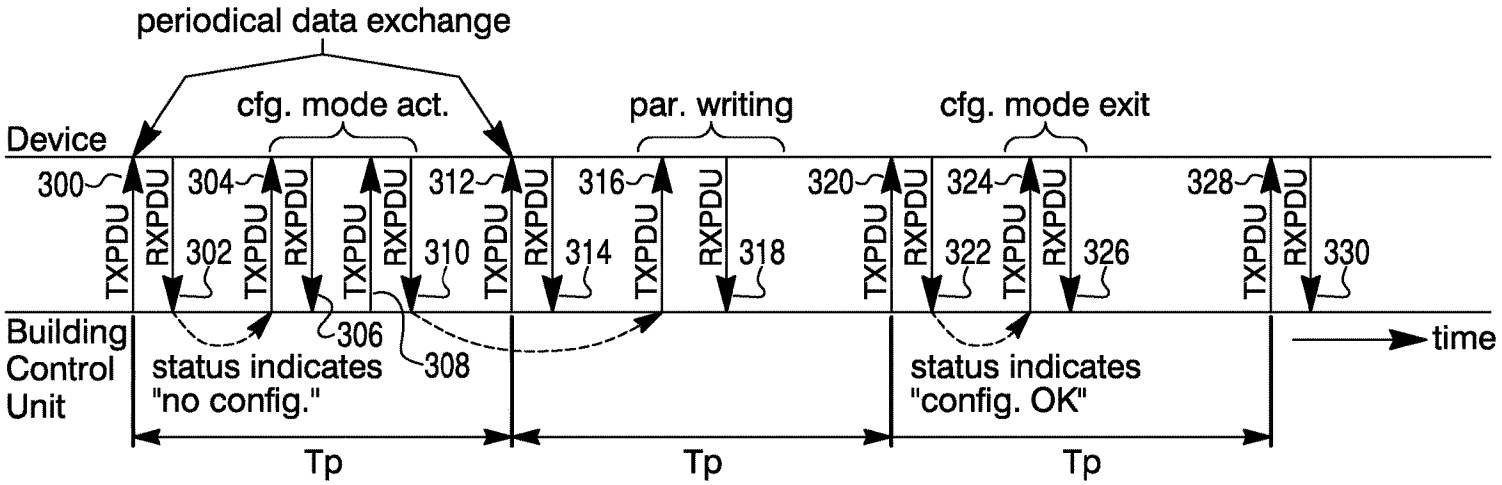
FIG. 3A depicts an example of aperiodic messages being used to transfer parameters to configure a device.

FIG. 3A depicts an example of aperiodic messages being used to transfer parameters to configure a device from the burner devices 206. In this example, the processing module 212 may compose the request data 232 and the communication module 210 may obtain the address for the device such that the burner control unit 208 may send a first periodic request message 300 to the device. In response, the processing module 212 may compose the response data 232 and the communication module 210 may coordinate the exchange of a first periodic response message 302 to the burner control unit 208. In some cases, the processing module 212 may identify from the status bits 250 (i.e., RxData) that the device is not configured or is not configured properly. Accordingly, the processing module 212 may compose a first aperiodic request message or multiple aperiodic request messages 304, 308 and the communication module may coordinate the exchange of the aperiodic request messages 304, 308 from the burner control unit 208 to the device to activate a configuration mode of the device. In some cases, the processing module 212 may compose a first aperiodic response message or multiple aperiodic response messages 306, 310 and the communication module may coordinate the exchange of the aperiodic response messages 306, 310 from the device to the burner control unit 208 to indicate that the device is ready to be activated and that it is in configuration mode.

Figure 3B:
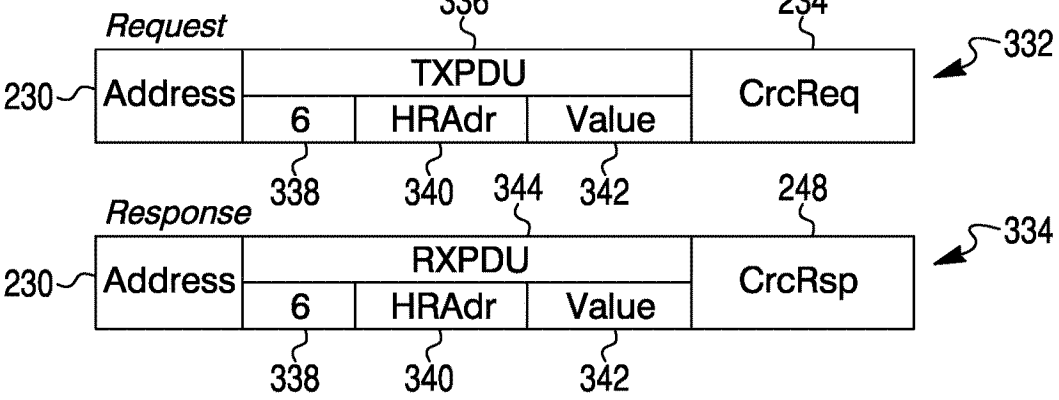
FIG. 3B depicts examples of Modbus aperiodic protocol message structures for an aperiodic request message and an aperiodic response message.

Turning to FIG. 3B, examples of Modbus aperiodic protocol message structures for configuration mode activation are shown for an aperiodic request message 332 and an aperiodic response message 334. The Modbus request message 332 may contain the address 230 of the device, request data 336 (e.g., TXPDU), and the Modbus frame 234 (e.g., CrcReq) calculated from the address 230 and the request data 336. In some cases, the request data 336 may include function code 338 (e.g., write command 6), control bits 340 (e.g., HRAdr), and an error check 342 (e.g., Value). In some cases, the Modbus response message 334 may contain the address 230 of the device, response data 344 (e.g., RXPDU), and the Modbus frame 248 (e.g., CrcRsp) calculated from the address 230 and the response data 344. In some examples, the response data 344 may be an echo of the request data 336 such that the response data 344 includes the function code 338, the control bits 340, and the error check 342.

Turning back to FIG. 3A, as shown by the exchange of a second periodic request message 312 and a second periodic response message 314, the periodic messaging may continue during the configuration of the device. From the second periodic response message 314 the processing module 212 may identify that the device has yet to be configured. In some cases, once the device is in configuration mode, the communication module 210 may coordinate the exchange of a third aperiodic request message 316 containing the parameters necessary to configure the device and the communication module 210 may coordinate the exchange of a third aperiodic response message 318 indicating that the device has received the parameters.

Figure 3C:
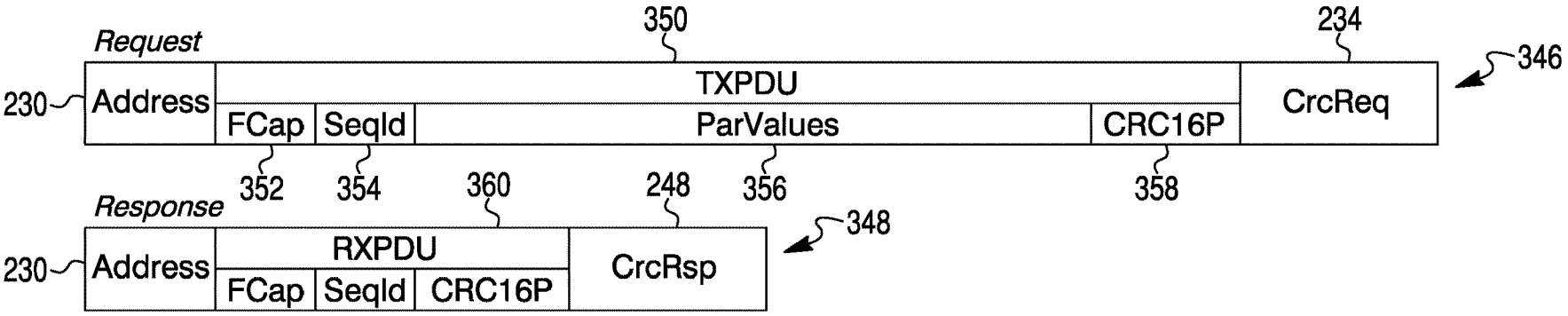
FIG. 3C depicts further examples of Modbus aperiodic protocol message structures for an aperiodic request message and an aperiodic response message.

Turning to FIG. 3C, examples of Modbus aperiodic protocol message structures for exchanging parameters are shown for an aperiodic request message 346 and an aperiodic response message 348. The Modbus request message 346 may contain the address 230 of the device, request data 350 (e.g., TXPDU), and the Modbus frame 234. In some cases, the request data 350 may include function code 352 (e.g., FCap), communication transaction identification 354 (e.g., SeqId), parameter values 356 (e.g., ParValues), and an error check 358 (e.g., CRC16P). In some cases, the Modbus response message 348 may contain the address 230 of the device, response data 360 (e.g., RXPDU), and the Modbus frame 248. In some examples, the response data 344 may indicate that the device has received the parameters by including the function code 352, the communication transaction identification 354, and the error check 358. In some instances, when the processing module 212 identifies that a parameter(s) is out of range in the aperiodic response message 348, the processing module may determine that the device may not be operating properly and lock-out the device and/or the burner control unit 208.

Turning back to FIG. 3A, in some instances, a third periodic request message 320 may then be sent to the device and the device may send a third periodic response message 322 to the burner control unit 208. In some cases, the processing module 212 may identify from the status bits 250 of the third periodic response message 322 that the device is now configured properly. Accordingly, the communication module 210 may coordinate the exchange a fourth aperiodic request message 324 for the device to exit the configuration mode. In response, the communication module 210 may coordinate the exchange of a fourth aperiodic response message 326 indicating that the device has exited the configuration mode. Moreover, as shown by the exchange of a fourth periodic request message 328 and a fourth periodic response message 330, the controller 204 may continue managing the communication of the burner system to provide safety control over the burner system.

Figure 4:
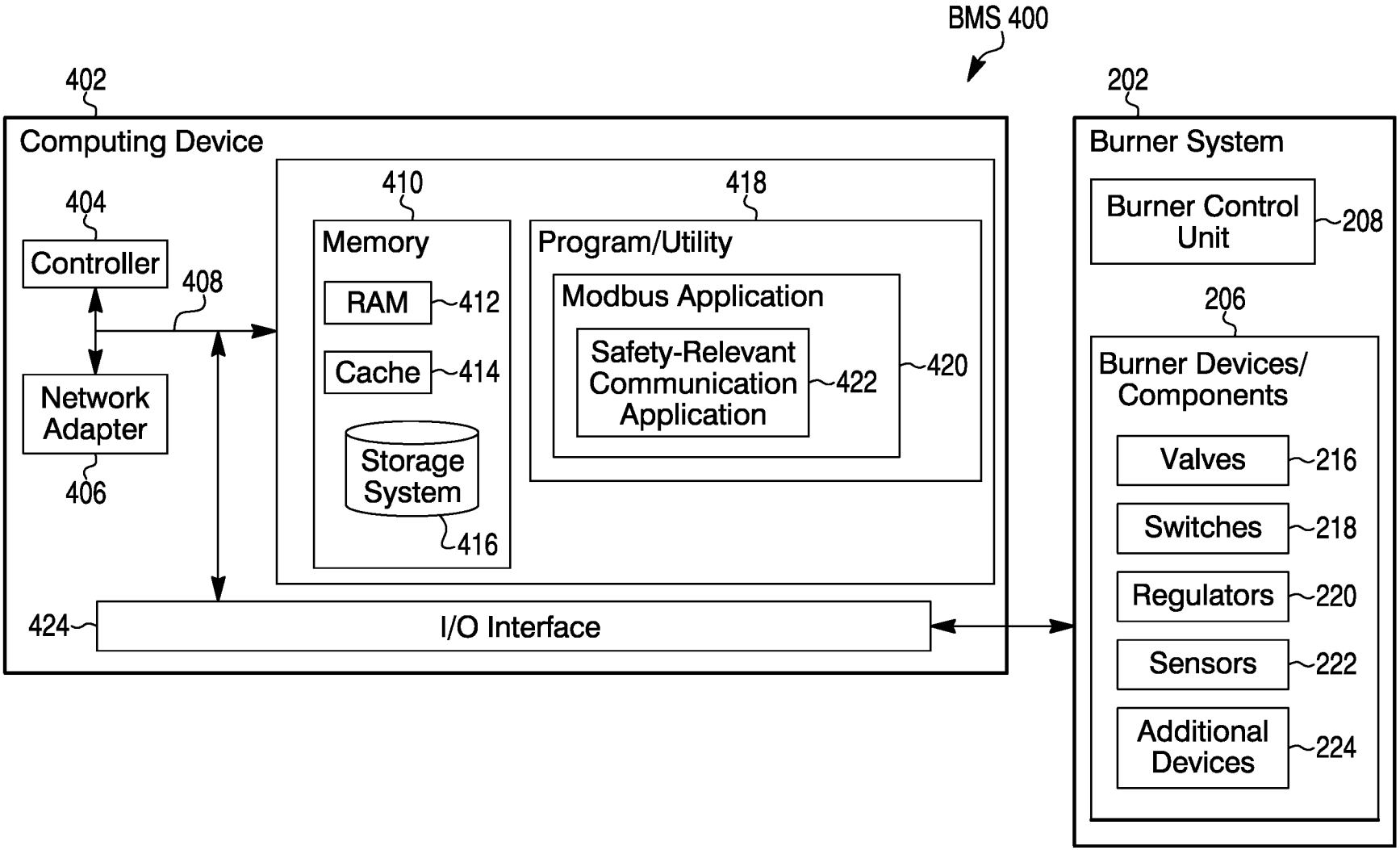
FIG. 4 is another schematic block diagram of an illustrative BMS.

FIG. 4 is a schematic block diagram of an illustrative burner management system (BMS) 400. In some cases, the BMS 400 may be configured to perform the operations similar to the BMS 200, from FIG. 2A. In some cases, the BMS 400 may include a computing device 402 and the burner system 202. In the example shown, the computing device 402 can perform various communication and data transfer functions and can execute one or more application functions. The components of computing device 402 may include, but are not limited to, a controller 404, memory 410, a network adapter 406, and input/output (I/O) interface(s) 424, and a bus 408 that couples various system components including the memory 410 to the controller 404. The controller 404 may execute instructions stored in the memory 410. According to various embodiments, the controller 404 and the memory 410 may have functionality and storage capacity as desired to facilitate proper management of the burner system 202 and communication with the burner devices/components 206 and the burner control unit 208. In some cases, the computing device 402 may be part of a remote server.

The memory 410 can include computer system readable media in the form of volatile memory, such as random access memory (RAM) 412 and/or cache memory 414. The computing device 402 may further include other removable/non-removable, volatile/non-volatile computer system storage media. By way of example only, storage system 416 can be provided for reading from and writing to a non-removable, non-volatile magnetic media (not shown and typically called a "hard drive").

In some cases, program/utility 418 may be stored in the memory 410 and may include a set of application program modules (e.g., software), such as the Modbus application 420. In some cases, the program/utility 418 may include additional program modules as well as an operating system, one or more other application program modules, and program data. According to various embodiments, the application program modules (e.g., the Modbus application) may include a safety-relevant communication application 422, for example. In some cases, the Modbus application 420, including the safety-relevant communication application 422, may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The safety-relevant communication application 422 may execute on the computing device 402. In some cases, the safety-relevant communication application 422 may execute on a remote device or the burner system 202 (e.g., the burner control unit 208, the burner device 206, or both). In some cases, part of the safety-relevant communication application 422 may be executed on the computing device 402 and part of the safety-relevant communication application 422 may be executed on a remote device or the burner system 202. In the latter scenario, the computing device 402 may be connected to the remote device or the burner system 202 through any type of network, including a local area network (LAN) or a wide area network (WAN), or the connection may be made to an external computer (for example, through the Internet using an Internet Service Provider). In certain instances, the network adapter 406 is included in the computing device 402 to support such communication.

In various embodiments, the computing device 402 may communicate with the burner system 202 and thus, the burner control unit 208 and the burner devices 206, via I/O interface(s) 424. In some cases, the burner system 202 may be managed by the computing device 402. In some cases, the computing device 402 may use the controller 404 to manage the communication of the burner system to provide safety control over the burner system. For instance, similar to controller 204, the controller 404 may be operatively coupled to I/O interface(s) 424 via the bus 408, the controller 404 may also access instructions from the safety-relevant communication application 422 to use the I/O interface 424 to manage an exchange of messages between the devices 206 and the burner control unit 208, identify issues regarding the messages, determine that devices or the burner control unit 208 may not be operating properly based on the identified issues, and in response, lock-out the devices and/or the burner control unit.

In some cases, the I/O interface 424 may be connected to the burner system 202 through a wired or wireless network, and in some cases the controller 404 may control the burner system 202 using one or more communication protocols. For example, in some instances, the controller 404 may use the Modbus application 420 to control the burner system 202 using the Modbus protocol messaging structure. In some cases, the controller 404 may control the burner system 202 through serial and/or parallel communication using protocols over a BACnet. Other protocols that the controller 404 may use may include, but are not limited to, 1-Wire, C-Bus, CC-Link Industrial Networks, DSI, Dynet, KNX, LonTalk, oBIX, VSCP, xAP, X10, Z-Wave, ZigBee, INSTEON, TCIP, and/or Ethernet.

Figure 5:
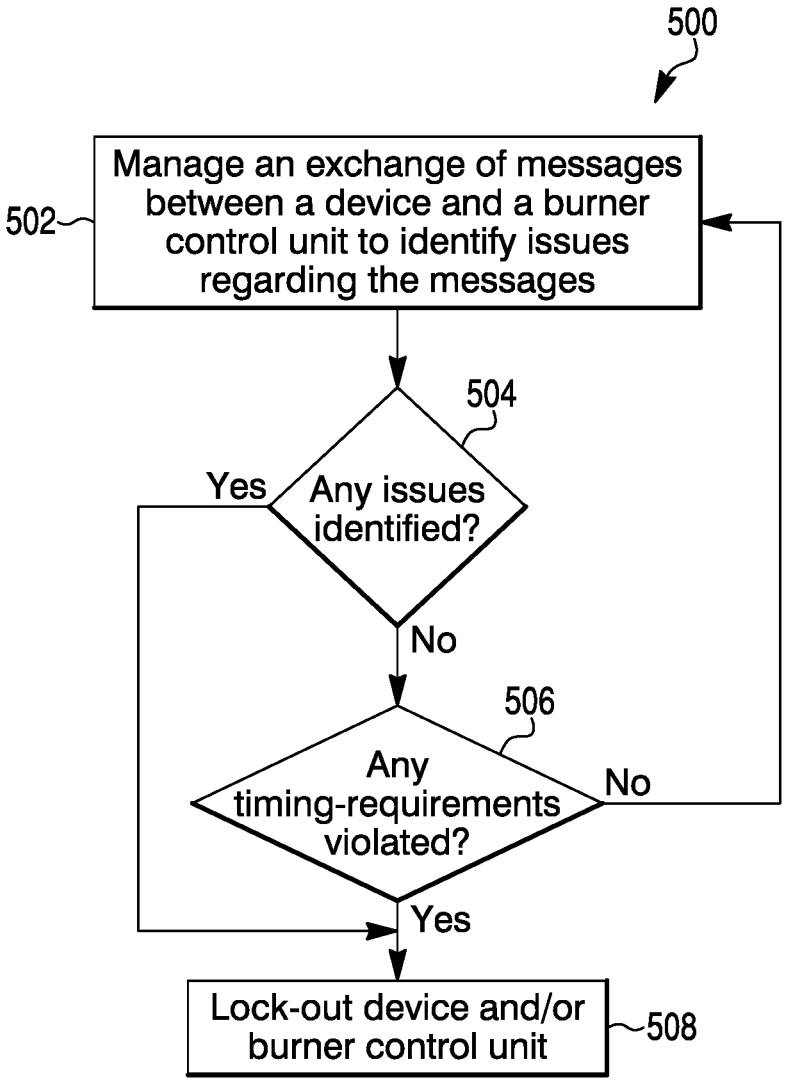
FIG. 5 depicts an illustrative approach.

FIG. 5 depicts an illustrative method 500 for providing safety control over a burner system using a controller. The method 500 begins at step 502, where the controller may manage an exchange of messages between a device of the burner system and a burner control unit of the burner system to identify issues regarding the messages. At step 504, the controller may determine whether any issues are identified. In some examples, the controller may identify that a message is an exception response. In some examples, the controller may identify that a communication transaction ID of a message is incorrect. In some examples, the controller may identify that the error check of a response message is not the same as in request message. In some examples, the controller may identify that a parameter(s) is out of range in a message. If the controller determines that an issue regarding the messages has been identified and that the device or the burner control unit may not be operating properly, at step 508, the controller may lock-out the device and/or the burner control unit. If the controller determines that an issue regarding the message has not been identified, at step 506, the controller may determine if a timing-requirement has been violated. In some examples, the controller may determine that a timing requirement has been violated when the number of messages received during an amount of time, is above a threshold. In some examples, the controller may determine that a timing requirement has been violated when a message is not received within an amount of time. If the controller determines that a timing requirement has been violated, at step 508, the controller may lock-out the device and/or the burner control unit. If the controller determines that a timing requirement has not been violated, at step 502, the controller may continue to manage the exchange of messages between the device of the burner system and the burner control unit.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic or optical disks, magnetic cassettes, memory cards or sticks, random access memories (RAMs), read only memories (ROMs), and the like.

In the present specification, some of the matter may be of a hypothetical or prophetic nature although stated in another manner or tense.

The above description is intended to be illustrative, and not restrictive. For example, the above-described examples (or one or more aspects thereof) may be used in combination with each other. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Description as examples or embodiments, with each claim standing on its own as a separate embodiment, and it is contemplated that such embodiments can be combined with each other in various combinations or permutations.

What is claimed is:

1. A controller for managing communication of a burner system, the controller comprising:

a communication module configured to manage an exchange of messages between devices of a burner system; and a processing module configured to:

compose the messages that are exchanged between the devices of the burner system, the messages include aperiodic messages, wherein the aperiodic messages are based on parameters of a specific event, or a change in setting requiring a modification to the behavior of the device of the burner system and the processing module is configured to lock-out at least one device of the burner system in response to a parameter of an aperiodic message being out of range;

identify issues regarding the messages exchanged between the devices of the burner system;

determine that a set of devices of the burner system may not be operating properly based on the identified issues regarding the messages;

lock-out at least one device of the burner system in response to determining that the set of devices of the burner system may not be operating properly;

wherein a timing module has a set of timing requirements and is configured to lock-out at least one device of the burner system in response to violation of one or more timing requirements from the set of timing requirements;

wherein the messages comprise periodic request messages including a first request message and a second request message, the second message being received subsequent to the first message;

wherein the timing module is configured to lock out at least one device of the burner system when a first timing requirement of the one or more timing requirements is violated, the first timing requirement requires that a predetermined number of the periodic request messages received during a predetermined amount of time is below a threshold; and wherein the timing module is configured to lock out at least one device of the burner system when a second timing requirement of the one or more timing requirements is violated, the second timing requirement requires that the first periodic request message is received within a first fixed interval time and wherein the second periodic request message is received within a second fixed interval of time, wherein the second fixed interval is longer than the first fixed interval.

2. The controller of claim 1, wherein the set of timing requirements includes a timing requirement that the periodic request messages must be received within a predetermined amount of time.

3. The controller of claim 1, wherein the set of timing requirements includes a timing requirement that response messages to the periodic request messages must be received within a predetermined amount of time.

4. The controller of claim 1, wherein the processing module determines that the set of devices of the burner system may not be operating properly when the processing module identifies that a message is an exception message.

5. The controller of claim 1, wherein the processing module determines that the set of devices of the burner system may not be operating properly when the processing module identifies a parameter in a message is outside a predetermined range.

6. The controller of claim 1, wherein the processing module determines that the set of devices of the burner system may not be operating properly when the processing module identifies a communication transaction identification is incorrect.

7. The controller of claim 1, wherein the messages comprise an address of a device, function code, communication transaction identification, control bits, and an error check.

8. The controller of claim 1, wherein the devices of the burner systems comprise a valve and a burner control unit.

9. A burner management system (BMS), comprising:

a device;

a burner control unit operatively coupled to the device and configured to communicate with the device; and a controller operatively coupled to the device and the burner control unit and configured to:

manage an exchange of messages between the device and the burner control unit, the messages include aperiodic messages and periodic request messages, wherein the aperiodic messages are based on parameters of a specific event, or a change in setting requiring a modification to the behavior of the device;

identify issues regarding the messages based on the management of the exchange of messages;

determine that at least one of the device and the burner control unit may not be operating properly based on the identified issues regarding the messages; and lock-out at least one of the device and the burner control unit in response to determining that the at least one of the device and the burner control unit may not be operating properly; and wherein the controller includes a set of timing requirements and the controller is further configured to lock-out at least one of the device and the burner control unit when the periodic request messages from the managed messages violates a first timing requirement from the set of timing requirements, the first timing requirement requires a number of the periodic request messages received during a predetermined amount of time to be below a threshold.

10. The system of claim 9, wherein the at least one timing requirement includes a requirement that the periodic request messages must be received within a predetermined amount of time.

11. The system of claim 9, wherein the set of timing requirements includes a timing requirement that response messages to the periodic request messages must be received within a predetermined amount of time.

12. The system of claim 9, wherein the controller determines that the at least one of the device and the burner control unit may not be operating properly when the controller identifies that a message is an exception message.

13. The system of claim 9, wherein the controller determines that the at least one of the device and the burner control unit may not be operating properly when the controller identifies a parameter in a message is outside a predetermined range.

14. The system of claim 9, wherein the controller determines that the at least one of the device and the burner control unit may not be operating properly when the controller identifies a communication transaction identification is incorrect.

15. A method of providing a safety control over a burner system using a controller, the method comprising:

managing an exchange of messages between a device of a burner system and a burner control unit of the burner system, the messages include aperiodic and periodic request messages, wherein the aperiodic messages are based on parameters of a specific event, or a change in setting requiring a modification to the behavior of the device of the burner system and wherein the periodic request messages including a first periodic request message and a second periodic request message, the second periodic request message being received subsequent to the first periodic request message;

identifying issues regarding the messages based on a management of the exchange of messages;

determining that at least one of the device and the burner control unit may not be operating properly based on the identified issues regarding the messages; and locking-out at least one of the device or the burner control unit in response to determining that the at least one of the device and the burner control unit may not be operating properly; and wherein the locking-out at least one of the device or the burner control unit includes locking out the at least one of the device or the burner control unit in response to determining one or both of the first periodic request message was not received within a first fixed interval time and the second periodic request message was not received within a second fixed interval of time, wherein the second fixed interval is longer than the first fixed interval.

16. The method of claim 15, wherein the burner control unit is locked out in response to determining one or both of the first periodic request message was not received within the first fixed interval time and the second periodic request message was not received within the second fixed interval of time.

17. The system of claim 9, wherein the burner control unit is locked out when the periodic request messages from the managed messages violates the timing requirement that a number of the periodic request messages received during a predetermined amount of time to be below the threshold.

* * * * *